United States Patent [19]

Ruud

[11] Patent Number: 4,886,215

[45] Date of Patent: Dec. 12, 1989

[54] HAND OPERATED POWDER SPRAY PISTOL

[75] Inventor: Jan Ruud, Hjälteby, Sweden

[73] Assignee: Nordson Corporation, Westlake, Ohio

[21] Appl. No.: 323,076

[22] Filed: Mar. 14, 1989

Related U.S. Application Data

[63] Continuation of Ser. No. 67,302, Jun. 17, 1987, abandoned.

[30] Foreign Application Priority Data

Oct. 18, 1985 [SE] Sweden ..... 8504893

[51] Int. Cl.[4] ..... B05B 5/00; B05B 7/02

[52] U.S. Cl. ..... 239/690.1; 239/692; 239/696; 239/704; 239/526

[58] Field of Search ..... 239/3, 690, 690.11, 239/692, 696–698, 704–708, 525, 526, 530

[56] References Cited

U.S. PATENT DOCUMENTS

| | | | |
|---|---|---|---|
| 2,302,185 | 11/1942 | Campbell, Jr. . | |
| 3,870,232 | 3/1975 | Lacchia . | |
| 3,903,321 | 9/1975 | Schaad . | |
| 4,039,145 | 8/1977 | Felici et al. . | |
| 4,090,666 | 5/1982 | Peck . | |
| 4,359,192 | 11/1982 | Takahashi et al. . | |
| 4,399,945 | 8/1983 | Ruud | 239/697 |
| 4,401,275 | 8/1983 | Ruud | 239/704 |
| 4,597,534 | 7/1983 | Ruud | 239/704 |
| 4,597,534 | 7/1986 | Ruud . | |
| 4,634,058 | 1/1987 | Hollstein et al. . | |

FOREIGN PATENT DOCUMENTS

| | | | |
|---|---|---|---|
| 0163118 | 12/1985 | European Pat. Off. . | |
| 2283729 | 9/1974 | France . | |
| 2583310 | 12/1986 | France . | |
| 446824 | 7/1981 | Sweden . | |
| 446825 | 7/1981 | Sweden . | |
| 446826 | 10/1982 | Sweden . | |
| 83008565 | 8/1983 | Sweden . | |
| 569329 | 8/1977 | U.S.S.R. . | |
| 939106 | 6/1982 | U.S.S.R. . | |
| 1069863 | 1/1984 | U.S.S.R. | 239/692 |
| 774035 | 11/1984 | U.S.S.R. | 239/704 |
| 1069423 | 5/1967 | United Kingdom . | |
| 1482084 | 8/1977 | United Kingdom . | |
| 2047572 | 12/1980 | United Kingdom . | |

*Primary Examiner*—Andres Kashnikow
*Assistant Examiner*—William Grant
*Attorney, Agent, or Firm*—Wood, Herron & Evans

[57] ABSTRACT

A hand held powder spray gun is disclosed. The spray gun includes a casing enclosing a plurality of helical charging ducts mounted on parallel cores. The ducts receive powder from a diffusor mounted in a depending gun handle and discharge charged powder towards a nozzle mounted at one end of the casing.

13 Claims, 4 Drawing Sheets

HAND OPERATED POWDER SPRAY PISTOL

This application is a continuation-in-part, continuation of application Ser. No. 07/067,302, filed 6/17/87, now abandoned.

BACKGROUND OF THE INVENTION

The present invention relates to an arrangement for a powder sprayer intended for powder and equipped with an electrostatic charging facility for the powder, which includes a number of coiled charging ducts capable of receiving powder and a diffusor.

SUMMARY OF THE INVENTION

The principal object of the present invention is, in the first place, to produce an arrangement of the kind referred to above, which, in addition to functioning well, is light in weight and compact and is also suitable for manual operation.

Said object is achieved by means of an arrangement in accordance with the present invention, which is characterized essentially in that the sprayer includes a handle part projecting downwards from an upper casing part, said casing part enclosing the charging ducts in question packed tightly together, and in that at least a major part of the diffusor is accommodated and enclosed in the handle part.

The invention is described below as a preferred illustrative embodiment, in conjunction with which reference is made to the following drawings.

BRIEF DESCRIPTION OF THE DRAWINGS

FIG. 5 shows an oblique view from the front of a diffusor which is part of the spray pistol;

FIG. 6 shows a longitudinal cross sectional view of the diffusor;

FIG. 7 shows an oblique view from the rear of the spray pistol.

DESCRIPTION OF A PREFERRED EMBODIMENT

Figure 1:
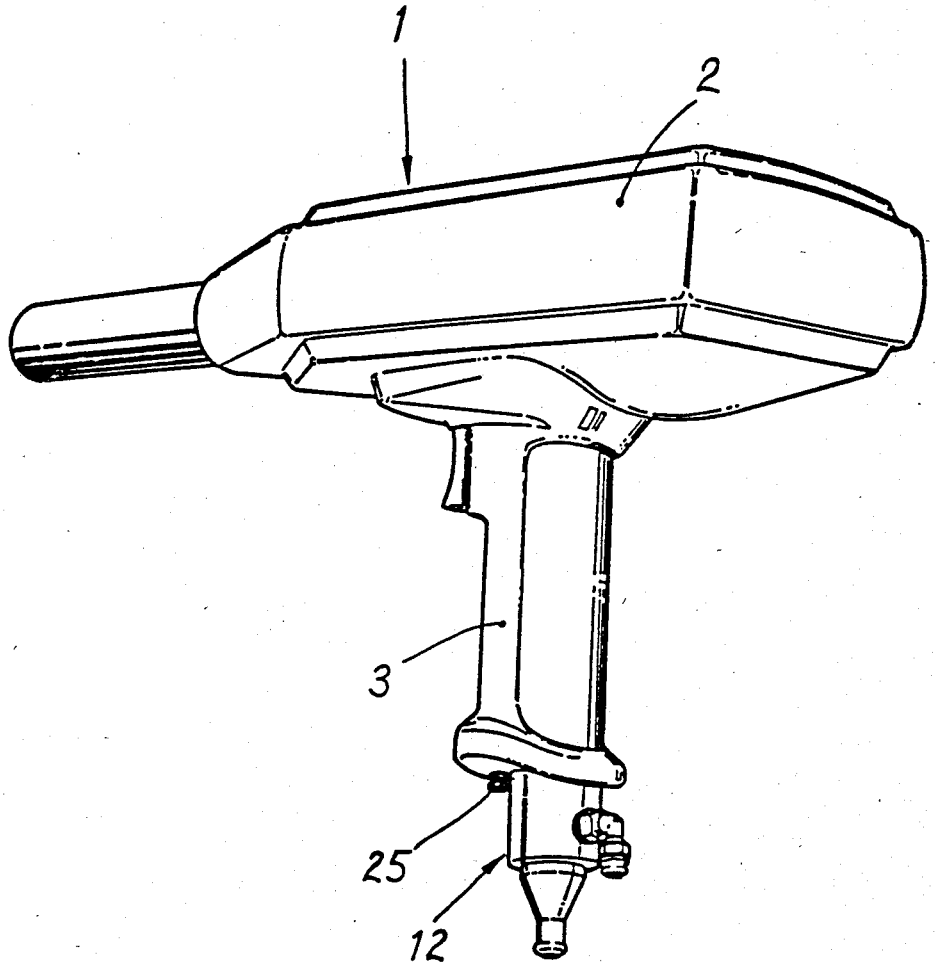
FIG. 1 shows an oblique view from the rear of a spray pistol arranged in accordance with the invention.
Figure 2:
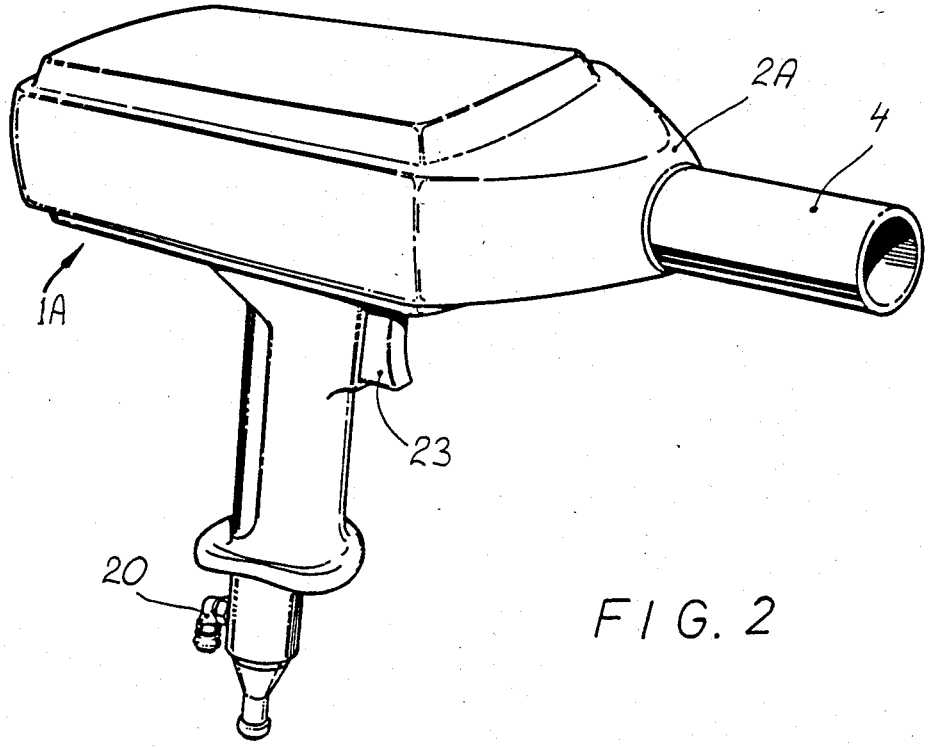
FIG. 2 shows an oblique view from the front of the spray pistol.

A powder sprayer 1 constructed in accordance with the present invention comprises, when the sprayer is held in its normal, upright spraying position, an upper casing part 2 and a handle part 3 projecting downwards at an angle from said casing part 2, and is shaped as to resemble a pistol, as shown in Figs. 1 and 2, for example. The powder spray pistol 1 is preferably made from a molded plastics material with a preferably tubular nozzle 4 situated at the front part 2A of the frame part and a number of components molded from the plastics material and accommodated on its inside.

Accommodated inside the casing part 2 are a number of coiled ducts 5–8 consisting of an electrically non-conductive material, preferably a plastics material, which are intended on the one hand to convey the quantity of powder supplied to the powder spray pistol 1 to the spray pistol nozzle 4, and on the other hand to charge the powder electrostatically through the effect of friction with the internal walls of the ducts. In order to permit the effective charging of the powder, each of said ducts 5–8 is curved along its section 5A–8A into a shape resembling that of a helix, with the ducts 5–8 being connected along their periphery with an electrically conductive material so as to permit the connection of the ducts 5–8 to earth or to a source of voltage. The aforementioned charging ducts 5–8 are packed tightly inside the casing part 2, with the helical coiled sections 5A–8A of the duct being accommodated in pairs 5A, 6A and 7A, 8A, respectively. Coiled sections 5A and 6A are mounted on core 9 which preferably consists of a metallic material, capable of being connected to earth or to a source of power. Coiled sections 7A and 8A are mounted on a similar core 10. Thus, in the design illustrated here, two cores 9, 10 are positioned in parallel in relation to one another and alongside one another. The tight packing of the ducts 5–8 is permitted, amongst other things, by the fact that the ducts 5–8 are supported with the axes of helical sections 5A, 6A; 7A, 8A parallel and the helical turns $5^1$, $6^1$, $7^1$, $8^1$ of each duct 5-8 being arranged alternately, i.e., so that one turn, for example, turn $5^1$ of one of the ducts 7 is adjacent to one turn, for example, turn $8^1$ of the second duct 8 and so on.

Figure 3:
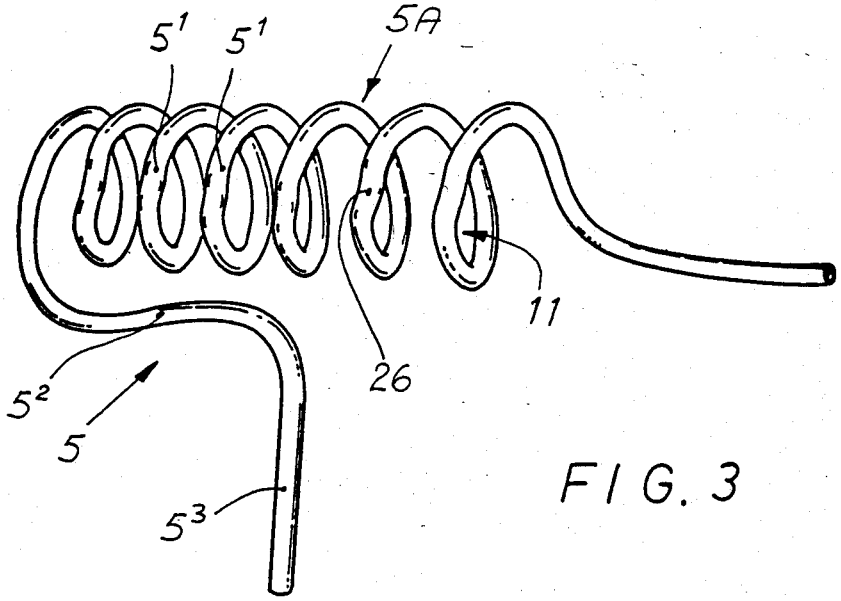
FIG. 3 shows a charging duct which is part of the spray pistol.

Each of the charging ducts 5–8, which may preferably be pre-formed in such a way as to exhibit the form illustrated in FIG. 3, for example, before it is installed in the spray pistol 1, thus enabling it to be connected easily to each core 9, 10 by being laid together in pairs in such a way that the helical turns $5^1$, $7^1$ and $6^1$, $8^1$ engage with one another, whereupon each coil is introduced into the central opening 11 of each helical section 5A-8A and preferably includes a part $5^2$–$8^2$ runnings along each helical part 5A–8A and a connecting part $5^3$–$8^3$ running at an angle to it.

Figure 4:
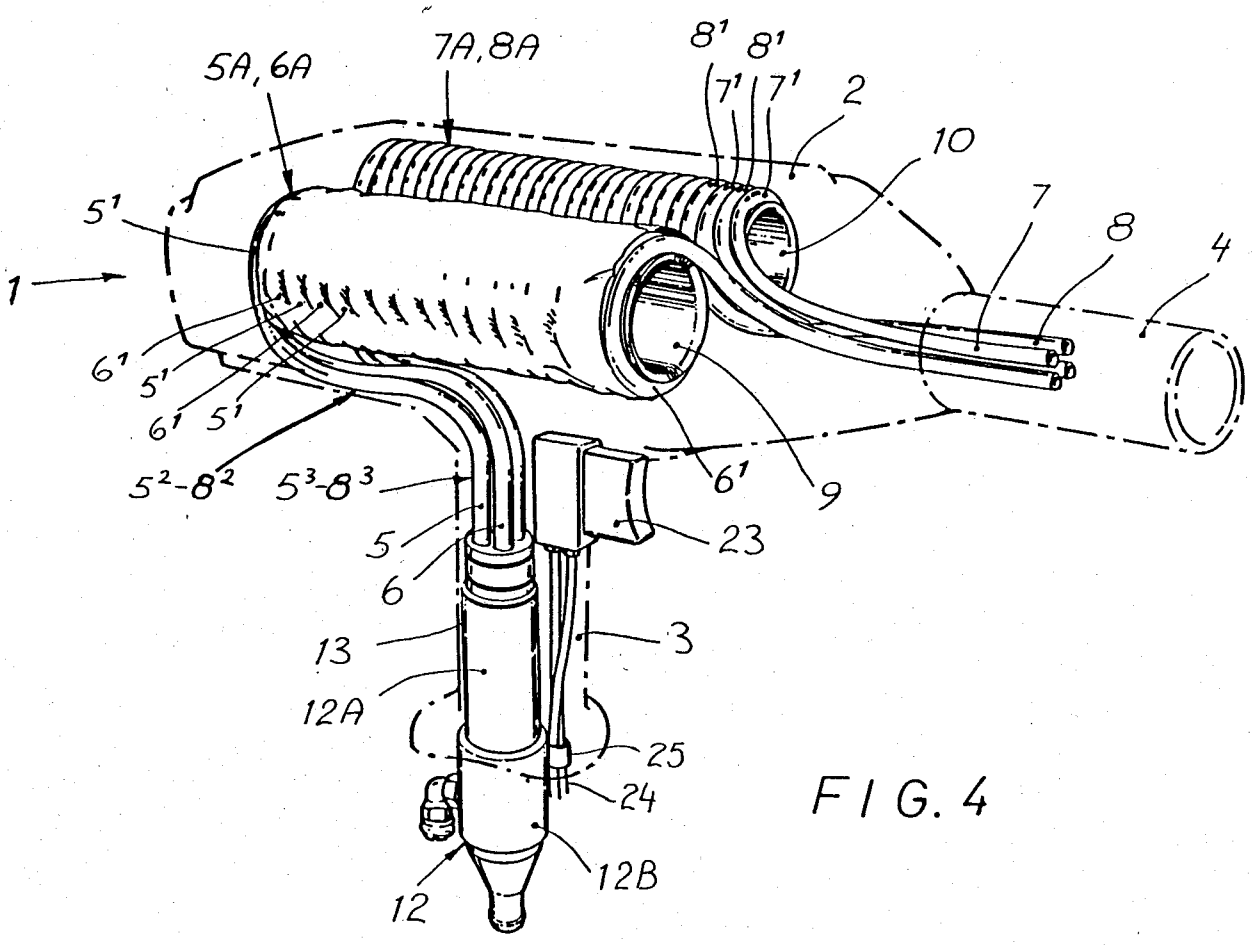
FIG. 4 shows a spray pistol with the casing outlined in phantom.

The aforementioned connecting parts $5^3$–$8^3$ are so arranged as to extend to a diffusor 12 accommodated by the handle part 3, a major part 12A of which at least is accommodated in the handle part 3 inside a hollow space 13, as clearly shown in FIG. 4. The charging ducts 5–8 are capable of being connected to an appropriate disc-shaped connecting part 14 in an attachment part 15 which is capable of being separated from the diffusor 12. A large number of passages 16 situated in said connecting part 14 and preferably arranged in the form of a ring serve not only as an attachment for each charging duct 5–8, but also as a trap for lumps of powder and other large objects which are not intended to pass through the openings 16 and into the charging ducts 5–8. The connecting part 14 of the diffusor 12, which preferably consists of a sleeve-shaped jacket part 17, a connecting hose attachment part 18 and an enclosed diffusor sleeve 19 provided with small holes, said diffusor having an air supply connection 20 attached to the jacket 17, may include annular grooves 21 situated at a certain distance from one another and in which O-rings 22 or other securing rings or similar hoop-shaped devices made of an electric material are accommodated. These securing devices 22 are so arranged as to interact with the inside of the diffusor accommodating space 13 of the handle part, amongst other things so as to secure the diffusor 12 to the spray pistol 1.

As will be appreciated from FIG. 4, the aforementioned air supply connection 20 is situated on a part 12B and the diffusor 12 projecting from the handle part 3, preferably facing towards the rear end 1A of the spray pistol.

The spray pistol 1 also includes an actuating mechanism 23, which, via lines 24 and a connection 25, permits connection to be made to a suitable power source, while the spray pistol 1 with its attachment 18 can be connected to a powder supply container via a hose.

The aforementioned charging ducts 5–8, may, for the purpose of further increasing the charging capacity of same, be bent in such a way that the helical-shaped part 5A-8A is provided with kinked sections 26, as shown in FIG. 3, whereby the powder which is transported through the spiral section is imparted with a reversed direction of movement as a result of the aforementioned kinked sections 26, such that the powder is agitated inside the ducts 5–8 and makes contact on all its surfaces with the internal walls of the ducts so that it is charged effectively.

The proposed spray pistol is light in weight and easy to use, in addition to which it is effective in use.

The invention is not restricted to the illustrative embodiment described above and illustrated in the drawings, but may be modified within the scope of the Patent Claims without departing from the idea of invention.

We claim:

1. A hand held powder spray gun comprising:
a casing;
a nozzle mounted at one end of said casing;
a handle depending from said casing;
at least two charging ducts mounted within said casing, said charging ducts having a first end in communication with said nozzle and a second end;
a diffusor, said diffusor being in communication with said second end of charging ducts; and;
said diffusor being mounted within said handle.

2. The spray gun of claim 1 in which said diffusor includes a body, said body having a plurality of parallel grooves formed on the periphery thereof, and an elastic ring carried in each of said grooves and adapted to engage said handle to secure said diffusor in place.

3. The spray gun of claim 2 in which said body includes a first portion and an attachment member releasably secured to said first portion, said grooves being formed in said attachment member.

4. The spray gun of claim 2 in which said diffusor body comprises a projecting portion, and an air inlet mounted on said projecting portion and communicating with the interior of said diffusor body.

5. The spray gun of claim 1 in which said spray gun further comprises a core member disposed within said casing,
said charging ducts being packed on said core,
said charging ducts being formed of an electrically non-conductive material.

6. A hand held powder spray gun comprising: a casing;
a handle mounted at one end of said casing;
a handle depending from said casing;
a pair of helical charging ducts mounted within said casing,
a core member disposed within said casing,
said helical ducts including helical section surrounding said core, said helical ducts having a first end in communication with said nozzle and a second end;
a diffusor, said diffusor being in communication with said second end of said helical ducts; and
said diffusor being mounted within said handle.

7. The spray gun of claim 6 further comprising a second core and a second pair of helical charging cuts surrounding said second core, and connected to said diffusor and to said nozzle, said first and second cores having axes parallel to one another.

8. The spray gun of claim 7 in which ducts are formed of an electrically non-conductive material, each said pairs of helical charging ducts comprising a first duct and a second duct, the coils of said first and said second ducts being alternately disposed along said cores.

9. The spray gun of claim 6 in which each of said helical charging ducts further includes a connecting section intermediate said helical section and said second end, said connecting section including a portion extending parallel to and adjacent to said helical section.

10. The spray gun of claim 9 in which said connecting section includes a second portion extending at an angle to said first named portion, said second portion being disposed in said handle.

11. The spray gun of claim 6 in which said diffusor includes a body, said body having a plurality of parallel grooves formed on the periphery thereof, and an elastic ring carried in each of said grooves and adapted to engage said handle to secure said diffusor in place.

12. The spray gun of claim 11 in which said body includes a first portion and an attachment member releasably secured to said first portion, said grooves being formed in said attachment member.

13. The spray gun of claim 11 in which said diffusor body comprises a projecting portion, and an air inlet mounted on said projection portion and communicating with the interior of said diffusor body.

* * * * *

UNITED STATES PATENT AND TRADEMARK OFFICE

CERTIFICATE OF CORRECTION

PATENT NO. : 4,886,215

DATED : December 12, 1989

INVENTOR(S) : Jan Ruud

It is certified that error appears in the above-identified patent and that said Letters Patent is hereby corrected as shown below:

Column 4, line 6, "handle" should be --nozzle--.

Column 4, line 18, "cuts" should be --ducts--.

Column 4, line 47, "projection" should be --projecting--.

Signed and Sealed this

Twenty-third Day of October, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,886,215

DATED : December 12, 1989

INVENTOR(S) : Jan Ruud

It is certified that error appears in the above-identified patent and that said Letters Patent is hereby corrected as shown below:

In the Abstract, line 4, "diffusor" should be --diffuser--.

In column 1, line 13, "diffusor" should be --diffuser--.

In column 1, line 27, "diffusor" should be --diffuser--.

In column 1, line 43, "diffusor" should be --diffuser--.

In column 1, line 45, "diffusor" should be --diffuser--.

In column 2, line 37, "diffusor" should be --diffuser--.

In column 2, line 44, "diffusor" should be --diffuser--.

In column 2, line 50, "diffusor" should be --diffuser--.

In column 2, line 53, "diffusor" should be --diffuser--.

In column 2, line 54, "diffusor" should be --diffuser--.

In column 2, line 60, "diffusor" should be --diffuser--.

In column 2, line 62, "diffusor" should be --diffuser--.

In column 2, line 65, "diffusor" should be --diffuser--.

In column 3, line 31, "diffusor" (both occurrences) should be --diffuser--.

In column 3, line 32, between "of" and "charging", insert --said--.

UNITED STATES PATENT AND TRADEMARK OFFICE

CERTIFICATE OF CORRECTION

PATENT NO. : 4,886,215

DATED : December 12, 1989

INVENTOR(S) : Jan Ruud

It is certified that error appears in the above-identified patent and that said Letters Patent is hereby corrected as shown below:

In column 3, line 33, "diffusor" should be --diffuser--.

In column 3, line 34, "diffusor" should be --diffuser--.

In column 3, line 38, "diffusor" should be --diffuser--.

In column 3, line 43, "diffusor" should be --diffuser--.

In column 3, line 46, "diffusor" should be --diffuser--.

In column 4, line 14, "diffusor" (both occurrences) should be --diffuser--.

In column 4, line 16, "diffusor" should be --diffuser--.

In column 4, line 20, "diffusor" should be --diffuser--.

In column 4, line 22, between "which" and "ducts", insert --said helical charging--.

In column 4, line 36, "diffusor" should be --diffuser--.

In column 4, line 40, "diffusor" should be --diffuser--.

In column 4, line 45, "diffusor" should be --diffuser--.

In column 4, line 48, "diffusor" should be --diffuser--.

UNITED STATES PATENT AND TRADEMARK OFFICE

CERTIFICATE OF CORRECTION

PATENT NO. : 4,886,215

DATED : December 12, 1989

INVENTOR(S) : Jan Ruud

It is certified that error appears in the above-identified patent and that said Letters Patent is hereby corrected as shown below:

Column 4, line 48, "diffusor" should be --diffuser--.

Signed and Sealed this

Seventeenth Day of August, 1993

*Attest:*

Bruce Lehman

BRUCE LEHMAN

*Attesting Officer*

*Commissioner of Patents and Trademarks*